US005624331A

United States Patent [19]

Lo et al.

[11] Patent Number: 5,624,331

[45] Date of Patent: Apr. 29, 1997

[54] COMPOSITE-METAL GOLF CLUB HEAD

[75] Inventors: Kun-Nan Lo; Wu-Hsiang Chung; Hsueh-Cheng Liao, all of Taichung Hsien, Taiwan

[73] Assignee: Pro-Kennex, Inc., San Diego, Calif.

[21] Appl. No.: 544,965

[22] Filed: Oct. 30, 1995

[51] Int. Cl.[6] ..... A65B 53/04

[52] U.S. Cl. ..... 473/345; 473/346; 473/347

[58] Field of Search ..... 273/167 H, 167 R, 273/78, 173; 473/324, 329, 345, 346, 347, 348, 344, 350

[56] References Cited

U.S. PATENT DOCUMENTS

| | | | |
|---|---|---|---|
| 4,139,196 | 2/1979 | Riley | 273/167 H |
| 5,288,070 | 2/1994 | Chen | 273/167 H |
| 5,328,176 | 7/1994 | Lo | 273/167 H |
| 5,425,538 | 6/1995 | Vincent et al. | 273/167 H |
| 5,431,396 | 7/1995 | Shieh | 273/167 H |
| 5,467,983 | 11/1995 | Chan | 273/167 H |

FOREIGN PATENT DOCUMENTS

| | | | |
|---|---|---|---|
| 664438 | 1/1952 | United Kingdom | 273/77 |

*Primary Examiner*—Mark S. Graham
*Attorney, Agent, or Firm*—Brown, Martin, Haller & McClain

[57] ABSTRACT

A composite-metal wood-style golf club head having a metal casing with at least two openings in the crown in which composite covers are disposed. The portion of the metal casing between the covers defines a bar-like stiffener that extends between the face and the back in a direction generally perpendicular to the face. The metal stiffener braces and reinforces the face against flexure during impact with the ball, while the composite covers optimize weight distribution and provide other advantages. The club head may include a composite core with a relative thick portion behind the hitting face to further reinforce the hitting face against flexure.

23 Claims, 2 Drawing Sheets

COMPOSITE-METAL GOLF CLUB HEAD

BACKGROUND OF THE INVENTION

1. Field of the Invention

The present invention relates generally to a composite-metal golf club head and, more specifically, to a head having a metal casing with a stiffener portion between two composite covers for reinforcing the hitting face against flexure.

2. Description of the Related Art

Golf clubs traditionally have been constructed almost entirely from a single type of material. Examples of such materials include wood, metal, and fiber-resin composites (such as graphite-epoxy). Herein, "wood" golf club refers to a club having a large, ellipsoidal head, as opposed to an "iron" golf club having a blade-like metal head. Referring to these clubs as "woods" or "irons" does not necessarily mean, however, that the clubs are constructed from actual wood or iron. Indeed, recently, the golf industry has turned its attention away from wood-style golf clubs made from various woods, such as persimmon, focusing instead on metal and composite materials. The reason for this shift stems from various performance improvements that can be attained by replacing wood with metal or composite in wood-style clubs.

The hitting face of a wood-style club head may deform or flex inwardly when impacting a golf ball. Face flexure wastes energy that could otherwise be transferred to the ball. Face flexure is particularly acute in wood-style club heads having a hollow composite or metal casing.

It would be desirable to provide a composite-metal wood-style club head that minimizes face flexure. These problems and deficiencies are clearly felt in the art and are solved by the present invention in the manner described below.

SUMMARY OF THE INVENTION

The present invention is directed to a generally hollow, composite-metal golf club head having a metal casing with at least two openings in the crown in which portions of at least one composite element are disposed. The composite portions may comprise two "covers," each disposed in one of the openings. The portion of the metal casing between the covers defines a stiffener that extends between the face and the back in a direction generally perpendicular to the face. The metal stiffener braces the face against flexure during impact with the ball, while the composite covers minimize weight and provide other advantages. The club head may include a composite core. The core may have a thickened portion behind the hitting face that further reinforces the face. The club head may have selected proportions, by weight and surface area, of metal and composite materials.

The present invention is also directed to a method of making the composite-metal golf club head. The composite portions are inserted in the metal casing. The assembly is then heated to cure the composite and bond the composite to the metal.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DETAILED DESCRIPTION OF THE INVENTION

Figure 1:
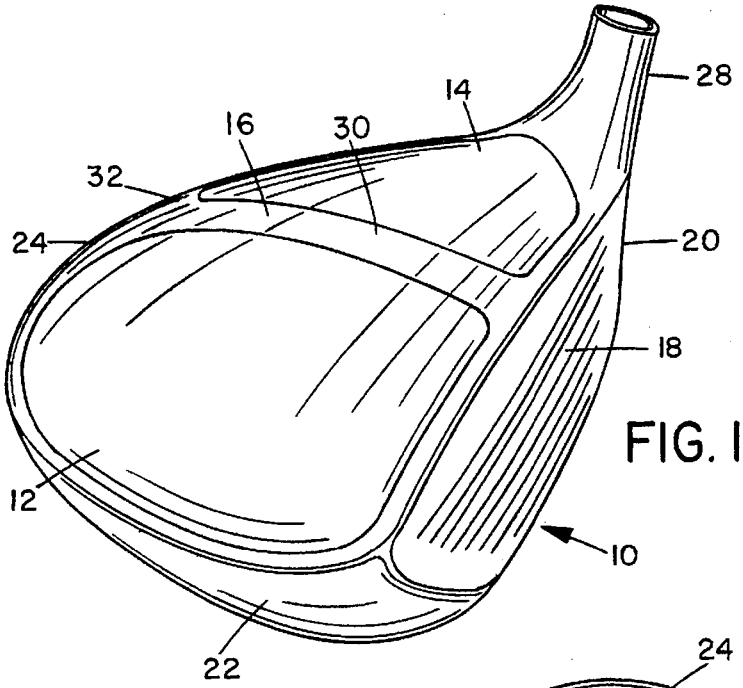
FIG. 1 is a perspective view of a composite-metal golf club head.
Figure 2:
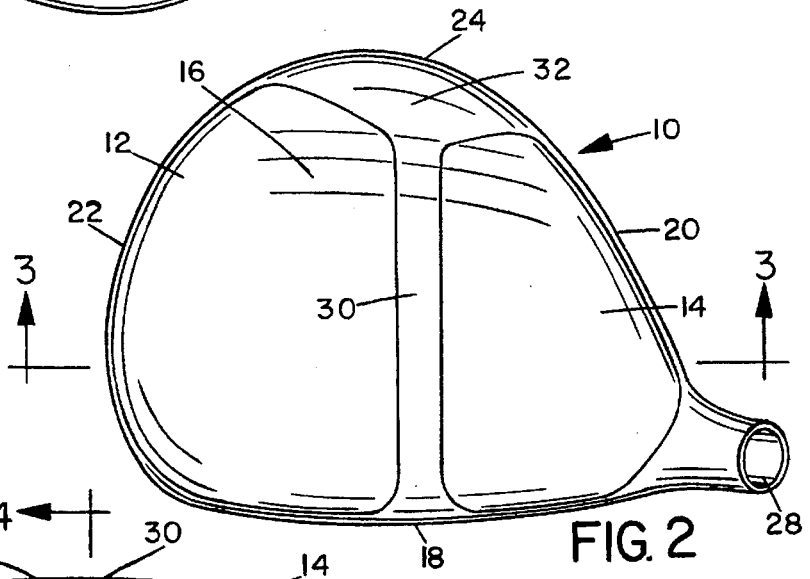
FIG. 2 is a top plan view of the golf club head.
Figure 3:
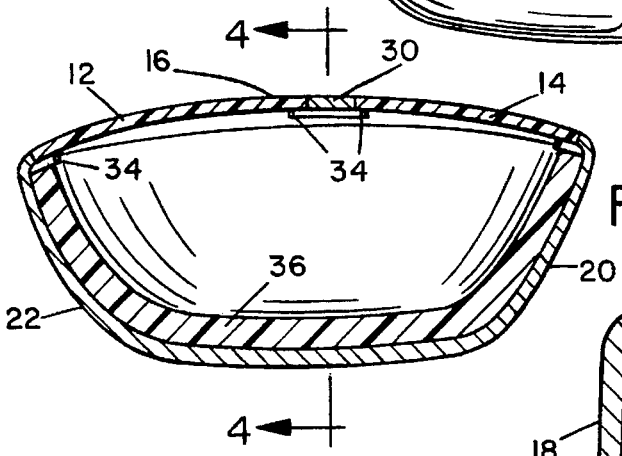
FIG. 3 is a sectional view taken along line 3—3 of FIG. 2.
Figure 4:
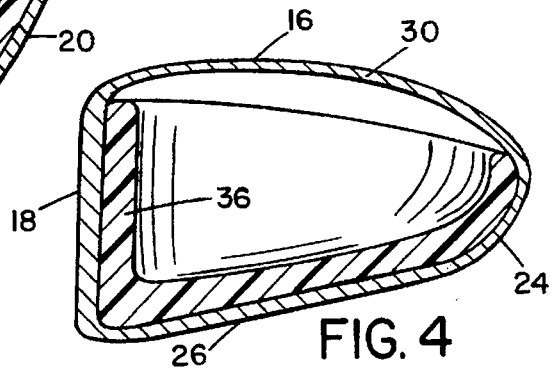
FIG. 4 is a sectional view taken along line 4—4 of FIG. 3.
Figure 5:
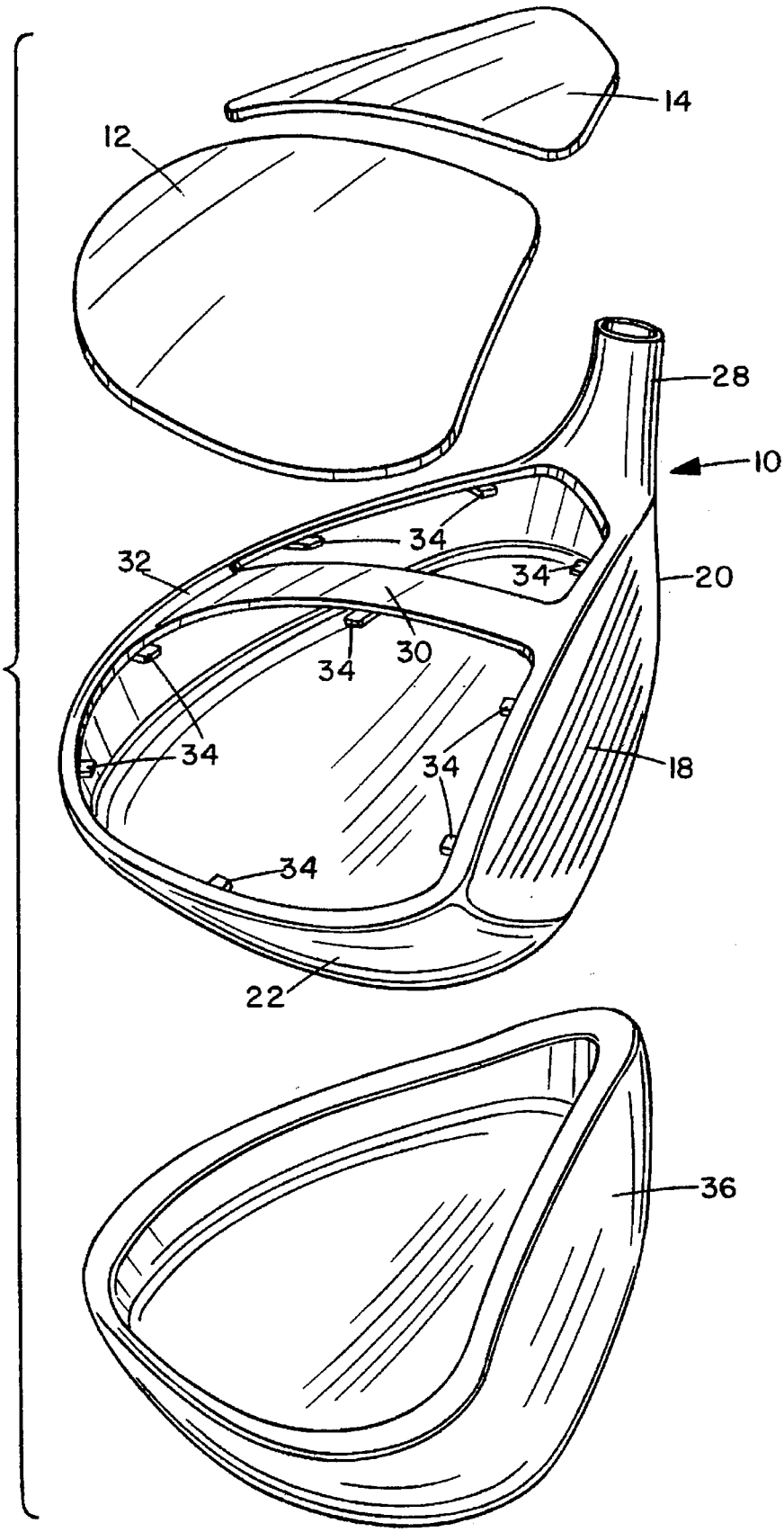
FIG. 5 is an exploded view of the components of the golf club head.

As best illustrated in FIG. 5, a wood-style golf club head includes a metal casing 10 and two composite covers 12 and 14 that, when assembled, together define the surfaces of the head. As illustrated in FIGS. 1–4, these surfaces include a crown 16, a face 18, a heel 20, a toe 22, a back 24 and a sole 26. Metal casing 10 includes a hosel 28 for connecting it to a shaft (not shown). A portion of casing 10 between covers 12 and 14 defines a bar-shaped stiffener 30 that extends from face 18 to back 24. Stiffener 30 may have an enlarged or broadened portion 32 adjacent back 24 to distribute forces more evenly but is otherwise preferably bar-shaped and uniform in width. The width of stiffener 30 is preferably between approximately 3% and 15% of the distance between heel 20 and toe 22. The thickness of stiffener 30 is preferably between approximately 2% and 20% of its width.

As described in further detail below, the combined effects of the metal and composite elements provide advantages of light weight, strength, and optimized center of gravity. Despite having less metal than a conventional club head, face 18 resists flexure due to the reinforcing or bracing effect of stiffener 30. The club imparts more energy to the ball (not shown) because face flexure is minimized. A golfer using a club that includes the present invention may therefore hit the ball farther than the golfer would hit the ball using a club having a conventional head.

Together, metal casing 10 and composite covers 12 and 14 constitute most (or all) of the head total surface area, which is defined as the combined area of the surfaces of crown 16, face 18, heel 20, toe 22, back 24 and sole 26. Metal casing 10 may account for between approximately 50% and 85% of the total surface area, but preferably accounts for approximately 66% of the total surface area.

Similarly, each component of the head contributes a portion of the total weight of the head. Metal casing 10 may account for between approximately 30% and 55% of the total weight of the head, but preferably accounts for approximately 40% of the total weight.

Metal casing 10 is formed from stainless steel or other durable metal. As illustrated in FIG. 5, covers 12 and 14 are shaped to fit within correspondingly shaped openings in metal casing 10 on crown 16 of the club head. Metal casing 10 may have one or more ridges or protrusions 34 within these openings for supporting covers 12 and 14 such that their outer surfaces are flush with the outer surface of metal casing 10, thereby forming a smooth crown 16.

For reasons described further below relating to advantages of weight distribution and strength, the thickness of metal casing is an important aspect of the invention. As illustrated in FIGS. 3 and 4, at sole 26 metal casing 10 is at least approximately 0.8 millimeters (mm) thick, but is preferably approximately 1.1 mm thick. At face 18 metal casing is at least approximately 1.0 mm thick, but is preferably approximately 1.5 mm thick.

Covers 12 and 14 are preferably made of graphite-epoxy composite, although any other suitable fiber composite may be used. Covers 12 and 14 may be between approximately 1.0 and 3.5 mm thick. The selected thickness depends on the characteristics and desired weight distribution (i.e., desired effect) in the club head, but a thickness of between 2.0 and 2.5 mm is preferred. Covers 12 and 14 account for between approximately 15% and 50% of the total surface area, and between approximately 7% and 20% of the total weight. Because covers 12 and 14 contribute significantly less weight to the overall club head than a comparable steel crown would contribute to a conventional metal club head, the club head of the present invention has a lower center of gravity than a conventional metal club head. In other words, the center of gravity in the present invention is closer to sole 26 and further from crown 16 than in a conventional club head. In the illustrated embodiment, the center of gravity is approximately 12% lower than it would be in an otherwise similar club head having a steel crown. The low center of gravity promotes a high ball trajectory.

As illustrated in FIGS. 3–5, a composite liner or core 36 having a shape corresponding generally to the interior contours of metal casing 10 is disposed within metal casing 10. Core 36 is preferably made of a graphite-epoxy composite, although any other suitable fiber composite may be used. Portions of core 36 are distributed within metal casing 10 so as to optimize the performance characteristics of the club. Core 36 thus is preferably disposed within several surfaces of the club head, including face 18, heel 20, and toe 22. Nevertheless, core 36 may alternatively be disposed within only one such surface or within any combination of the three surfaces, and/or additional surfaces, depending on the desired performance characteristics of the club. A portion of core 36 thus may also be disposed within back 24.

Core 36 does not, however, affect the overall weight of the club head relative to a conventional club head, but rather allows the club maker to exercise greater control over weight distribution. The weight difference between the illustrated crown having covers 12 and 14 and a conventional steel crown may be redistributed to other areas of the club head by selecting the thickness of core 36 in these areas, thereby enhancing performance characteristics of the club without increasing overall club weight.

The portion of core 36 within face 18 is preferably thicker than other portions to further reinforce face 18 against flexure. The portion of core 36 within face 18 is at least 2.0 mm thick, but is preferably between approximately 3.0 and 5.0 mm thick. The total thickness of the club head at face 18 is thus at least approximately 3.0 mm (at least 2.0 mm of composite plus at approximately 1.0 mm of metal) but preferably approximately 6.0 mm (approximately 4.5 mm of composite plus 1.5 mm of metal). As such, in the present invention face 18 is much thicker than the face of a conventional metal wood, which, for example, in the BIG BERTHA® club, manufactured by Callaway Golf of San Diego, Calif., is only 3.0 mm thick and is not reinforced. Reinforcing face 18 with composite in this manner further minimizes face flexure.

A portion of core 36 may also be disposed at toe 22 and heel 20. Weighting the sides of the club head with composite in this manner enhances stability and thus promotes accurate ball trajectories. The thickness of core 36 at toe 22 and heel 22 depends on the desired stability and weight, but it is preferably between approximately 1.0 and 3.0 mm. As noted above, because portions of the club head that would conventionally be made of metal are made of an equal weight of composite, the selected amount of composite in core 36 does not affect the overall weight of the club head.

To assemble the club head, composite core 36 is inserted into metal casing 10, and composite covers 12 and 14 are inserted into the corresponding openings in casing 10. As noted above, protrusions 34 are distributed around the openings to support covers 12 and 14. The assembled head is then heated to secure the metal casing 10, composite core 36 and composite covers 12 and 14 together. The heat cures the epoxy resin, which in turn permanently bonds the composite elements to the metal. Preferably, the temperature at which the assembly is heated is in the range of between 140 and 160 degrees Celsius. The head may then be finished in any suitable manner. Further, the head may be "oversize," "midsize," or the like, depending on the golf market to which the clubs are directed.

The combined effects of composite and metal in the present invention provide advantages of reduced weight and optimized center of gravity. The stiffener bar and thicker face provide a more rigid contact zone for the club, thereby maximizing energy transfer from the club to the ball.

It will be apparent to those skilled in the art that various modifications and variations can be made in the present invention without departing from the spirit or scope of the invention. Thus, the present invention covers all such modifications and variations of this invention within the scope of the appended claims and their equivalents.

What is claimed is:

1. A composite-metal wood-style golf club head having a crown, a hitting face, a back, a sole, a heel, a toe, a total surface area, and a total weight, comprising:

a generally hollow metal head casing, said metal head casing having first and second openings with an elongated stiffener portion between said first and second openings and extending over said crown between said hitting face and said back; and at least one composite element disposed within said head casing and having portions disposed in said first and second openings.

2. The composite-metal wood-style golf club recited in claim 1, wherein said at least one composite element comprises:

a first composite cover disposed in said first opening; and a second composite cover disposed in said second opening.

3. The composite-metal wood-style golf club recited in claim 1, further comprising a composite core within said head casing.

4. The composite-metal wood-style golf club recited in claim 3, wherein a portion of said core adjacent said hitting face has a thickness of at least 2.0 min.

5. The composite-metal wood-style golf club recited in claim 1, wherein said openings are in said crown.

6. The composite-metal wood-style golf club recited in claim 1, wherein said portion of said metal casing defining said hitting face has a thickness of approximately 1.5 min.

7. The composite-metal wood-style golf club recited in claim 1, wherein a portion of said head casing extends from said back to said crown and adjoins an end of said stiffener on said crown.

8. The composite-metal wood-style golf club recited in claim 1, wherein said stiffener has a generally rectangular cross-sectional shape.

9. The, composite-metal wood-style golf club recited in claim 1, wherein said stiffener is generally perpendicular to said hitting face.

10. The composite-metal wood-style golf club recited in claim 1, wherein said stiffener has a width equal of between 3% and 15% of distance between said heel and said toe.

11. The composite-metal wood-style golf club recited in claim 10, wherein said stiffener has a thickness of between 2% and 20% of said width.

12. The composite-metal wood-style golf club recited in claim 1, wherein the combined surface area of said first and second composite covers is between 15% and 50% of said total surface area.

13. The composite-metal wood-style golf club recited in claim 1, wherein the combined weight of said first and second composite covers is between 7% and 20% of said total weight.

14. A composite-metal wood-style golf club head having a crown, a hitting face, a back, a sole, a heel, a toe, a total surface area, and a total weight, comprising:

a generally hollow metal head casing, said metal head casing having first and second openings in said crown with an elongated stiffener portion between said first and second openings extending over said crown and generally perpendicular to said hitting face;

a first composite cover disposed in said first opening;

a second composite cover disposed in said second opening; and composite core within said head casing.

15. The composite-metal wood-style golf club recited in claim 14, wherein a portion of said core adjacent said hitting face has a thickness of at least 3.0 mm.

16. The composite-metal wood-style golf club recited in claim 15, wherein said portion of said metal casing defining said hitting face has a thickness of at least 1.0 mm.

17. The composite-metal wood-style golf club recited in claim 14, wherein said stiffener has a width of between 3% and 15% of the distance between said heel and said toe.

18. The composite-metal wood-style golf club recited in claim 14, wherein said stiffener has a thickness of between 2% and 20% of said width.

19. The composite-metal wood-style golf club recited in claim 14, wherein the combined surface area of said first and second composite covers is between 15% and 50% of said total surface area.

20. The composite-metal wood-style golf club recited in claim 14, wherein the combined weight of said first and second composite covers is between 7% and 20% of said total weight.

21. A method for manufacturing a composite-metal wood-style golf club head having a crown, a hitting face, a back, a sole, a heel, a toe, a total surface area, and a total weight, comprising:

forming a generally hollow metal head casing, said metal head casing having first and second openings with an elongated stiffener portion between said first and second openings and extending over said crown between said hitting face and said back;

forming at least one composite element; and inserting said at least one composite element into said head casing with portions of said at least one composite element disposed in said first and second openings, thereby forming a head assembly; and heating said head assembly.

22. The method for manufacturing a composite-metal wood-style golf club head recited in claim 21, wherein:

said step of forming at least one composite element comprises the step of forming a first composite cover and a second composite cover; and said step of inserting said at least one composite element into said head casing comprises the steps of inserting said first composite cover into said first opening and inserting said second composite cover into said second opening.

23. The method for manufacturing a composite-metal wood-style golf club head recited in claim 22, wherein:

said step of forming at least one composite element further comprises the step of forming a composite core; and said step of inserting said at least one composite element into said head casing further comprises the step of inserting said composite core into said head casing.

* * * * *

UNITED STATES PATENT AND TRADEMARK OFFICE

CERTIFICATE OF CORRECTION

PATENT NO. : 5,624,331

DATED : April 29, 1997

INVENTOR(S) : Kun-Nan Lo, Wu-Hsiang Chung and Hsueh-Cheng Liao

It is certified that error appears in the above-indentified patent and that said Letters Patent is hereby corrected as shown below:

Column 4, claim 4, line 52, after "2.0" delete "min" and insert --mm--;
Column 4, claim 6, line 57: after "1.5" delete "min" and insert --mm--;
Column 4, claim 7, line 60: after "stiffener" insert --portion--;
Column 4, claim 8, line 63: after "stiffener" insert --portion--;
Column 4, claim 9, line 65: after " The" delete ","; line 66: after "stiffener" insert --portion--;
Column 5, claim 10, line 2: after "stiffener" insert --portion--; line 3: after "of" insert --the--;
Column 5, claim 11, line 5: after "stiffener" insert --portion--;
Column 5, claim 14, line 25: after "and" insert --a--;
Column 5, claim 17, line 33: after "stiffener" insert --portion--; and
Column 5, claim 18, line 36: after "stiffener" insert --portion--.

Signed and Sealed this

Thirtieth Day of June, 1998

*Attest:*

*Attesting Officer*

Bruce Lehman

BRUCE LEHMAN

*Commissioner of Patents and Trademarks*